US006955191B2

(12) United States Patent
Hockemeyer et al.

(10) Patent No.: US 6,955,191 B2
(45) Date of Patent: Oct. 18, 2005

(54) DEVICE FOR FORMING A LENO SELVEDGE

(75) Inventors: Kurt Hockemeyer, Borken-Weseke (DE); Matthias Klöcker, Borken-Weseke (DE)

(73) Assignee: Kloecker-Entwicklungs GmbH, Borken-Weseke (DE)

( * ) Notice: Subject to any disclaimer, the term of this patent is extended or adjusted under 35 U.S.C. 154(b) by 148 days.

(21) Appl. No.: 10/727,267

(22) Filed: Nov. 20, 2003

(65) Prior Publication Data

US 2004/0108012 A1 Jun. 10, 2004

(30) Foreign Application Priority Data

Dec. 10, 2002 (DE) ..... 102 57 519

(51) Int. Cl.[7] ..... D03C 7/00
(52) U.S. Cl. ..... 139/52; 139/51
(58) Field of Search ..... 139/16, 50–53, 139/92–93

(56) References Cited

U.S. PATENT DOCUMENTS 3,102,080 A * 8/1963 Gerhard et al. ..... 435/61
4,967,802 A * 11/1990 Klocker ..... 139/51
4,987,928 A * 1/1991 Gaisser ..... 139/52
5,040,571 A * 8/1991 Klocker et al. ..... 139/52
5,048,573 A * 9/1991 Klocker et al. ..... 139/54
6,102,080 A 8/2000 Hockemeyer et al.
6,116,291 A * 9/2000 Hockemeyer et al. ..... 139/51

FOREIGN PATENT DOCUMENTS

DE 38 18 680 C1 10/1989
DE 297 03 896 U1 9/1998

* cited by examiner

*Primary Examiner*—Rodney Lindsey
*Assistant Examiner*—Andrew W. Sutton
(74) *Attorney, Agent, or Firm*—Jordan and Hamburg LLP

(57) ABSTRACT

A device (1) for forming a leno selvedge, said device having two lifting healds (10, 20) and one half heald (30), the lifting healds (10, 20) having a securing element (13, 23; 14, 24) provided respectively at the upper and lower end thereof, said lifting healds (10,20) having, in the region of the lower end, at least one magnet for the foot (31*a*, 32*a*) of the half heald (30), each lifting heald (10, 20) having at least one magnet (18, 28) in the region of its upper end, the magnets (18, 28) of the two lifting healds (10, 20) of a leno selvedge device being polarized such that the healds attract each other.

8 Claims, 3 Drawing Sheets

DEVICE FOR FORMING A LENO SELVEDGE

FIELD OF THE INVENTION

The present invention relates to a device for forming a leno selvedge, said device comprising two lifting healds and one half heald, the lifting healds having a securing element provided respectively at the upper and lower end thereof, said lifting healds having, in the region of the lower end, at least one magnet for the foot of the half heald.

DESCRIPTION OF THE PRIOR ART

A leno selvedge device of the type mentioned herein above is described in DE 297 03 896 U1 and consists, as already explained, of two lifting healds and of one half heald that is alternately taken along by one of the lifting healds. The lifting healds are for their part mounted on heald ridge bars of the heald frames or on the heald frames themselves. In principle, a half heald is characterized by a U-shaped configuration, with the two legs joining at their upper end to form an eye for guiding the stationary thread. At their lower end, the legs of the half heald have a half heald foot. The lifting healds, for their part, are characterized by two legs, namely a lower and an upper leg, each lifting heald being provided at its end with a securing element by means of which it is received by the heald ridge bar or by the heald frame. The lower leg is thereby provided with a slot for guiding the leg of the half heald. In the lower portion of the lower leg, magnets are disposed on top of each other on either side of the slot, said magnets serving to slow down the half heald as it passes from one lifting heald to the other and being further intended to respectively control the half heald. By "control" it is meant that the half heald is reliably taken hold of by the respective one of the lifting healds that is intended to take it along. The leno thread alternately runs on the right or the left side between the leg of the half heald and the leg of the corresponding lifting heald. In this prior art leno selvedge device in which the lifting healds are provided with magnets at the respective lower end thereof, the magnets are polarized such that the two lifting healds will repulse each other. This results in a knock-kneed position of the two lifting healds of a leno selvedge device relative to each other. As a result of this knock-kneed position, the half heald is also tensioned. In this case, the half heald tends to creep upward. This signifies that, more specifically upon rupture of the stationary thread, there is a risk that, within a very short period of time on fast looms i.e., on looms with a very high number of wefts, the half heald is no longer held by the magnets but ascends so that in the end the lifting heald is no longer capable of taking hold thereof and the half heald falls into the loom. If the loom cannot be stopped immediately because e.g., the rupture of the thread has not been noticed immediately, this may cause considerable damage to the loom. As already explained, the above-mentioned risks apply more specifically to fast looms. However, such phenomena have also been observed on looms operating with a moderate number of wefts.

BRIEF SUMMARY OF THE INVENTION

It is therefore the object of the invention to provide a leno selvedge device of the type mentioned herein above that prevents the lifting healds of a leno selvedge device from being positioned in an "X" shape.

In accordance with the invention, the solution to this object is achieved in that each lifting heald has at least one magnet in the region of its upper end, the magnets of the two lifting healds of a leno selvedge device being polarized such that the healds attract each other. If it is made certain that the two lifting healds of a leno selvedge device are adjacent at their end sides in the region of their upper end, there is little risk that they be positioned in the above mentioned "X" shape in the region of their lower end. More specifically if the magnets in the lower portion of the lifting healds, meaning in the transition zone between the lower leg and the securing element, are polarized such that the lifting healds of a leno selvedge device again attract each other, there is no risk that the lifting healds be oriented in such an "X" shape in the way mentioned herein above. This means that, even if the number of wefts is high, the legs of the lifting healds of a leno selvedge device are always parallel, thus preventing the half heald from ascending even if the thread has broken while this parallel orientation of the lifting healds also results in far less load on the half heald.

It has further been found that damages resulting from half healds having fallen out of the leno selvedge device could be substantially reduced.

Further advantageous features will become apparent in the subordinate claims.

More specifically, there is for example provided that a lifting heald be comprised of a limit stop in the transition zone between the upper leg and the securing element, the at least one magnet being disposed within said limit stop. This stop serves to limit the movement of the heald ridge bar or the heald frame in order to ensure solid securement of the lifting heald on the heald frame or heald ridge bar. In the transition zone between the upper leg and the securing element, the other lifting heald is bent at a right angle, the at least one magnet being disposed in this right-angled bend. It is obvious therefrom that the magnets disposed in the upper portion of the respective one of the lifting healds are spaced but a small distance apart so that they finally are capable of ensuring that the lifting healds be always adjacent as a result of the attracting force of the magnets.

According to another feature of the invention there is further provided that each lifting heald comprises, in its lower leg, a slot for receiving a leg of the half heald, the lifting heald having two magnets disposed on top of each other on either side of the slot in the transition zone between the lower leg and the securing element, the magnets of each of the lifting healds of a leno selvedge device being polarized such that the magnets of the two lifting healds attract each other. This signifies that the lifting healds will not attract each other in the upper portion of the lifting healds only, but in the lower portion thereof as well so that parallel orientation of the lifting healds is made certain in any event.

In arranging the magnets as described herein above, more specifically as far as their polarization is concerned, one achieves that two neighboring leno selvedge devices having two lifting healds repulse each other. This means that, depending on the magnetic force of the magnets, two neighboring lifting healds are always spaced apart, this spacing preventing the lifting healds of one leno selvedge device from rubbing against the lifting healds of a neighboring leno selvedge device. Such a friction, and the wear it implies, are thus largely avoided.

According to another feature of the invention, there is provided that the two lower pairs of magnets have a differently oriented polarization so that, in combination with the half heald foot which is made, like the entire half heald, of a magnetizable material, a closed magnetic circuit is formed. The lower magnets may hereby be smaller than the magnets located on top of them because they merely perform the function of additionally preventing the half heald from striking through onto the lifting healds. Meaning, the two magnets that are disposed in the lower portion, meaning in the lower leg, of the lifting heald serve on the one side to slow down the half heald so as to take hold of the half heald foot, thus slowing down the movement of the half heald and, on the other side, to also take hold of the half heald foot in order to control the half heald as it passes from one lifting heald to the other.

Below the magnet disposed in the lower leg there is further provided a bed for the foot of the half heald, said bed conforming to the shape of the lower end of said half heald foot. This bed actually serves to receive and slow down the half heald if, for whatever reason, the magnetic force is not sufficient to slow down the half heald as it passes from one lifting heald to the other.

The invention is explained in further detail herein after with reference to the drawings.

DETAILED DESCRIPTION OF THE INVENTION

Figure 1:
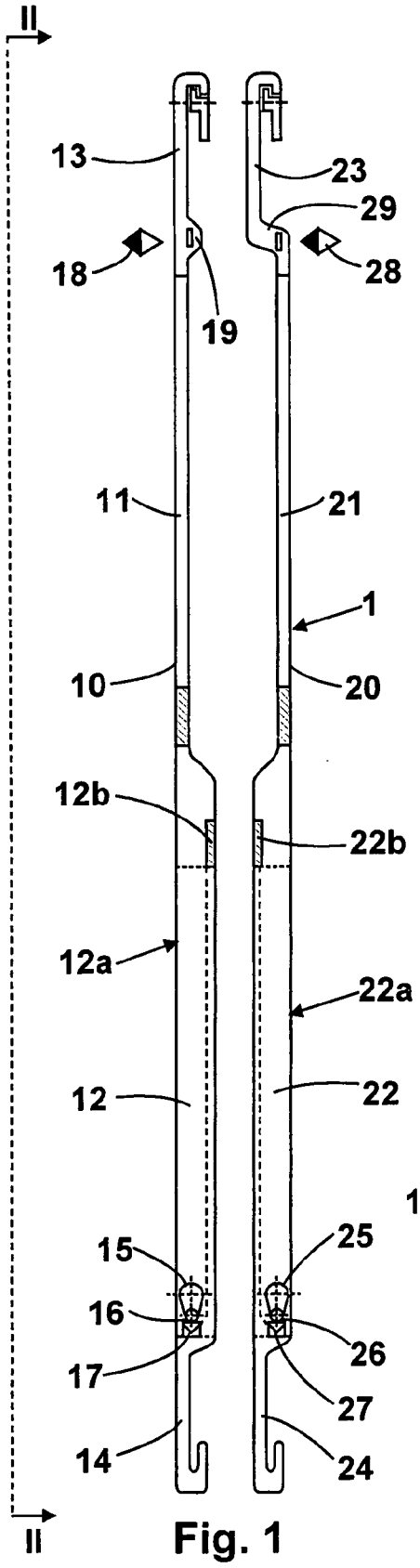
FIG. 1 is a side view of two lifting healds of a leno selvedge device.
Figure 2:
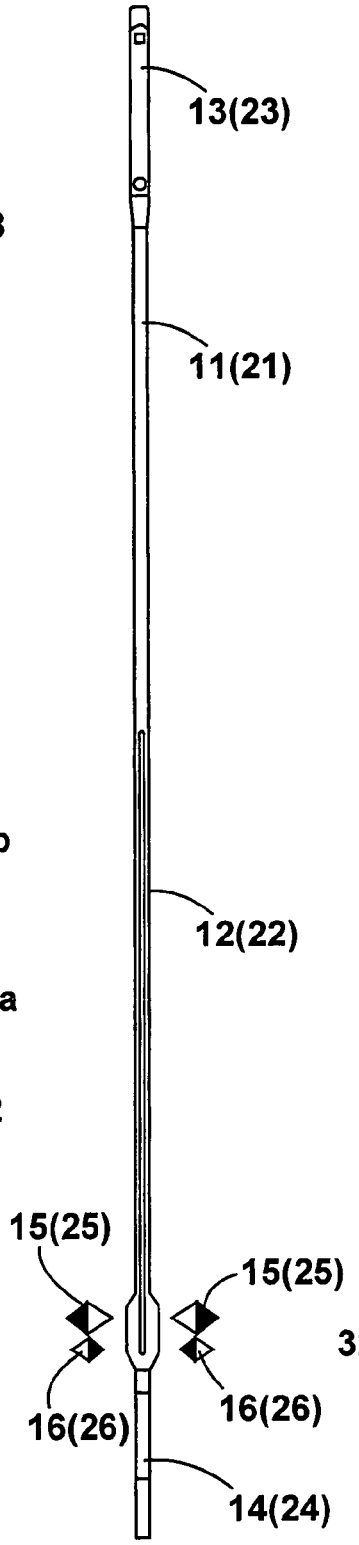
FIG. 2 is a view taken along line II—II FIG. 1.
Figure 3:
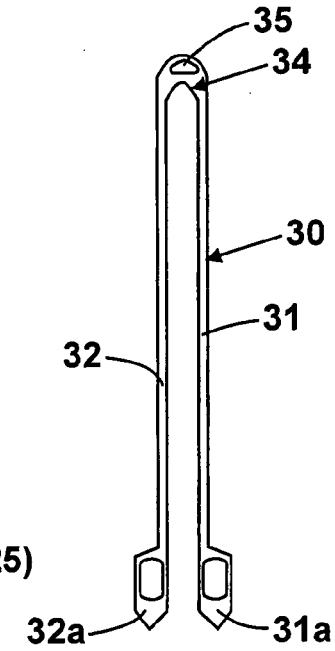
FIG. 3 is a view of the half heald.
Figure 4A:
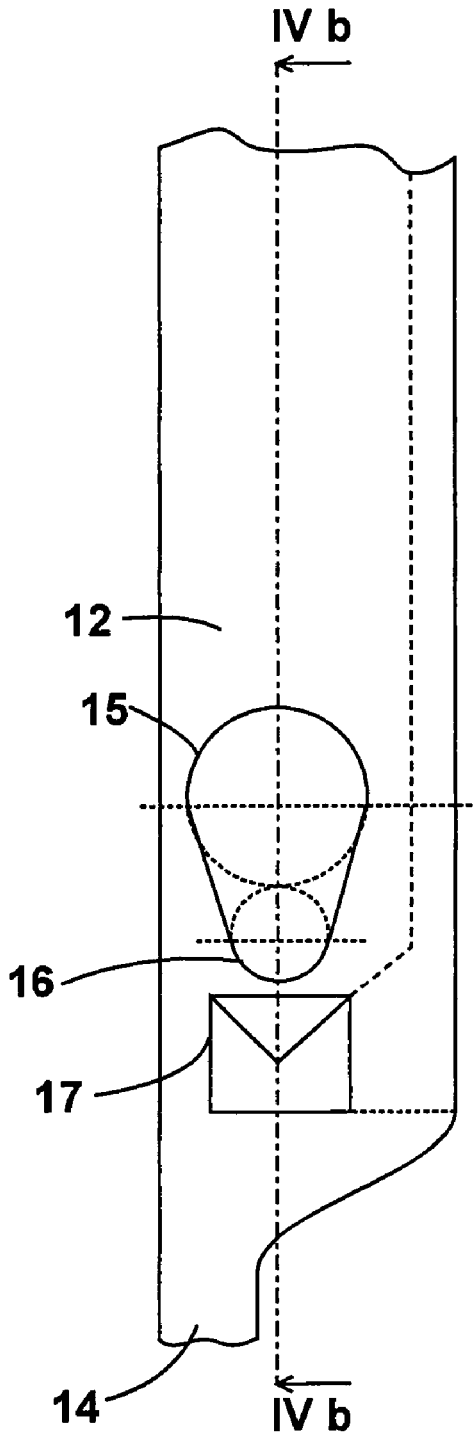
FIG. 4*a* is a detail of the one lifting heald with the lower magnet.
Figure 4B:
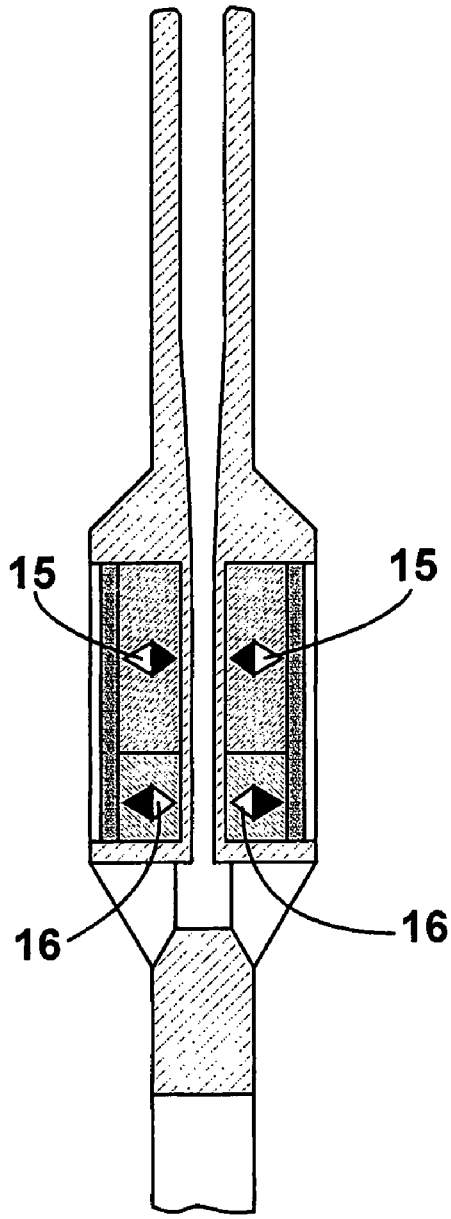
FIG. 4*b* is a sectional view taken along line IV b FIG. 4*a;*
Figure 5A:
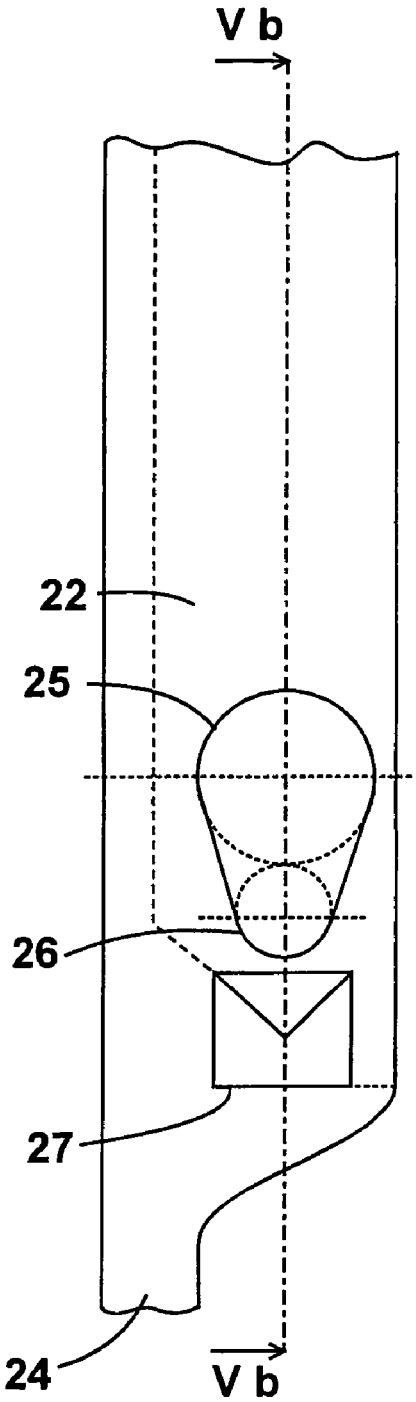
FIG. 5*a* is a representation according to FIG. 4*a* of the other lifting heald.
Figure 5B:
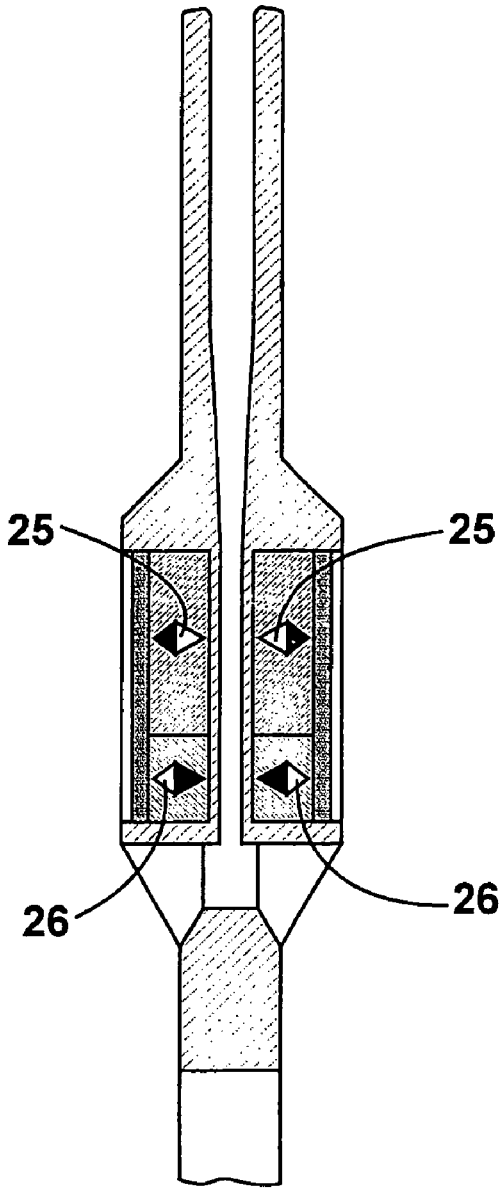
FIG. 5*b* is a sectional view taken along line V b FIG. 5*a*.

The leno selvedge device 1 comprises the two lifting healds 10 and 20 and the half heald 30. Each lifting heald 10, 20 has an upper leg 11, 21 and a lower leg 12, 22, each leg being adjoined with a securing element 13, 23 and 14, 24 respectively by means of which the lifting healds are secured to the heald ridge bars of the loom. The lifting healds 10, 20 receives the half heald indicated at 30. The fabrication principle of a leno selvedge using a leno selvedge device comprised of lifting healds and half healds is sufficiently well known. In this connection, the reader is referred to DE 38 18 680 C1 or to DE 297 038 96 U1, both describing the type of fabrication of a leno selvedge device. The half heald 30 has the two legs 31, 32 with the feet 31*a*, 32*a* provided at their end. Each lifting heald 10, 20 has a seat 12*b* and 22*b* respectively located in the region of the slot 12*a* and 22*a* respectively, the half heald resting thereon with its U-shaped end (arrow 34) in the region of the eye 35 for the stationary thread. The length of the leg 31 and 32 respectively hereby correlates with the spacing between the seat 12*b* and 22*b* respectively and the two magnets 15, 16 and 25, 26 respectively inasmuch as the latter are to take hold of the foot 31*a* and 32*a* respectively of the half heald 30. The arrangement of the magnets 15, 16 and 25, 26 respectively is best shown in FIG. 2; it can be seen clearly that the two upper magnets 15, 25 are larger than the two lower magnets 16, 26; and, what is even more important, the two pairs of magnets are oppositely polarized. In combination with the foot 31*a* and 32*a* respectively of the half heald, a closed magnetic circuit is thus obtained, which has been found to be very advantageous more specifically with regard to the deceleration of the half heald as it penetrates into the respective one of the lifting healds that takes it along, since this causes the half heald to be durably slowed down. For the case in which the magnetic force were not sufficient to completely slow down the half heald, a bed 17, 27 is provided beneath the magnet 16, 26, said bed being triangular to conform to the configuration of the lower end of the feet 31, 32*a* of the half heald 30. The function of said bed 17, 27 merely consists in intercepting the half heald so that it will not strike the seat 12*b* and 22*b* respectively with its upper end in the region of arrow 34.

The important point is that the two lifting healds 10, 20 are attracted by the magnets 15, 25 and 16, 26 respectively on account of the orientation of the magnets 15, 16 of the one lifting heald and of the complementary orientation of the magnets 25, 26 of the other lifting heald 20. Reviewing in this connection the upper end of the lifting healds 10, 20, it can be seen that these ends are also provided with magnets 18, 28; magnet 18 is disposed in the region of the limit stop 19 and magnet 28 in the region of the right-angled bend 29. Again, the magnets 18 and 28 are polarized so as to attract each other. As a result of the orientation of the magnets it should be noticed that the lifting healds are parallel in any event thanks to the attraction at the upper and at the lower end and are not possibly positioned like prior art healds in an "X" shape, which happens when the magnets repulse each other in the lower portion.

The polarization of the magnets can be seen in detail from the FIGS. 4*a*, 4*b* and 5*a*, 5*b*. It can be more specifically seen therefrom that, with two neighboring leno selvedge devices that are comprised of two lifting healds and one half heald each, the lifting healds of the one leno selvedge device and those of the neighboring leno selvedge device repulse each other due to the polarization of the magnets. This means that it is made certain that the lifting healds of two neighboring leno selvedge devices will by no means rub against each other, wear being substantially minimized as a result thereof.

We claim:

1. A device (1) for forming a leno selvedge, said device having two lifting healds (10, 20) and one half heald (30), the lifting healds (10, 20) having a securing element (13, 23; 14, 24) provided respectively at the upper and lower end thereof, said lifting healds (10, 20) having, in the region of the lower end, at least one magnet for the foot (31*a*, 32*a*) of the half heald (30), characterized in that each lifting heald (10, 20) has at least one magnet (18, 28) in the region of its upper end, the magnets (18, 28) of the two lifting healds (10, 20) of a leno selvedge device being polarized such that the healds attract each other.

2. The device according to claim 1, characterized in that the lifting healds (10, 20) have an upper and a lower leg (11, 21; 12, 22), each leg being provided at its end with the securing element (13, 23; 14, 24), at least one magnet (18, 28) being disposed in the transition zone between the upper leg and the securing element.

3. The device according to claim 2, characterized in that the one lifting heald (10) has a limit stop (19) provided in the transition zone between the upper leg (11) and the securing element (13), the at least one magnet (18) being disposed within the limit stop (19).

4. The device according to claim 2, characterized in that the other lifting heald (20) has a right-angled bend (29) provided in the transition zone between the upper leg (21) and the securing element (23), the at least one magnet (28) being disposed in the right-angled bend (29).

5. The device according to claim 2, characterized in that each lifting heald (10, 20) comprises, in its lower leg (12, 22), a slot (12*a*, 22*a*) for receiving a leg (31, 32) of the half heald (30), said lifting heald having two magnets (15, 16; 25, 26) disposed on top of each other on either side of the slot in the transition zone between the lower leg (12, 22) and the securing element (14, 24), the magnets of each of the lifting healds of a leno selvedge device being polarized such that the magnets (15, 16; 25, 26) of the two lifting healds (10, 20) attract each other.

6. The device according to claim 5, characterized in that the two lower pairs of magnets (15, 16; 25, 26) have a differently oriented polarization so that, in combination with the foot (31*a*, 32*a*) of the half heald (30), a closed magnetic circuit is formed.

7. The device according to claim 5, characterized in that below the magnet (15, 16; 25, 26) disposed in the lower leg (12, 22), there is further provided a bed (17, 27) for the foot of the half heald (30), said bed conforming to the shape of the lower end of the foot (31*a*, 32*a*) of the half heald (30).

8. The device according to claim 5, characterized in that the lower magnets (16, 26) are smaller than those disposed on top thereof.

* * * * *